US005251869A

United States Patent [19]

Mason

[11] Patent Number: 5,251,869

[45] Date of Patent: Oct. 12, 1993

[54] ROTARY BLOWOUT PREVENTER

[76] Inventor: Benny M. Mason, 955 Dairy Ashford #218, Houston, Tex. 77059

[21] Appl. No.: 998,939

[22] Filed: Dec. 30, 1992

Related U.S. Application Data

[63] Continuation-in-part of Ser. No. 915,929, Jul. 16, 1992, abandoned.

[51] Int. Cl.[5] ..... E21B 33/06

[52] U.S. Cl. ..... 251/1.2; 251/1.1

[58] Field of Search ..... 251/1.1, 1.2

[56] References Cited

U.S. PATENT DOCUMENTS

| | | | |
|---|---|---|---|
| Re. 20,631 | 1/1938 | MacLatchie | 251/1.1 X |
| 4,099,699 | 7/1978 | Allen | 251/1.2 |
| 5,178,215 | 1/1993 | Yemulis et al. | 251/1.1 X |

*Primary Examiner*—John C. Fox

*Attorney, Agent, or Firm*—James L. Jackson

[57] ABSTRACT

A rotary blowout preventer is provided having a resilient sealing body which is deformed about a drill string or sealing by means of a tapered actuator cone. The actuator cone is driven by a piston which is responsive to annulus pressure and which is also selectively responsive to opening and closing pressures such as for test cycling. A bearing box assembly is interposed between the piston and the actuator cone, thus enabling the actuator cone and resilient primary packing to rotate along with the drill string. The primary packing incorporates a replaceable, tubular central resilient secondary packing section which is supported in place by a releasable hanger assembly. The primary packing is rotatably driven by a bearing supported drive assembly incorporating drive dogs which establish driving relation with the sealing rubber thereof. The blowout preventer also incorporates an internal packing which may be controllably hydraulically energized in the event the packing should develop a leak during use. The blowout preventer is further provided with a continuously flowing oil bath for insuring cooling and cleaning of the bearing assembly thereof. The secondary packing, which is subjected to greater wear than the primary packing, is replacable without necessitating disassembly of the housing. The interrelated primary and secondary packings are also applicable to non-rotatable blowout preventers.

25 Claims, 4 Drawing Sheets

ROTARY BLOWOUT PREVENTER

This Application is a continuation-in-part of U.S. patent application Ser. No. 07/915,929, filed on Jul. 16, 1992 by this same inventor, and entitled ROTARY BLOWOUT PREVENTER, now abandoned.

FIELD OF THE INVENTION

This invention relates generally to blowout preventers for establishing sealing about drill pipe extending through a drilling well head to prevent blowout of the well being drilled in the event a high pressure petroleum zone is encountered during drilling operations. More particularly, the present invention is directed to a blowout preventer construction having primary and secondary internal packing elements through which the drill string extends and which are mechanically deformed responsive to predetermined annulus pressure to establish a seal with the drill string while rotating therewith. The secondary packing is located so as to accommodate most of the wear to which the packing system is subjected and is simply and efficiently replacable when worn without necessitating disassembly of the housing.

BACKGROUND OF THE INVENTION

During well drilling operations for discovery of petroleum producing zones, it is necessary to provide well drilling equipment with blowout prevention capability in the event a high pressure zone is encountered during drilling. When drilling a deep well, drilling fluid, typically known as "drilling mud" is provided with appropriate constituents to enhance the drilling of the earth formation by means of a drill bit located at the lower end of a drill string composed of a number of drilling pipe sections, drilling subs, etc. To insure that high pressure natural gas which may suddenly enter the well bore when a gas bearing production zone is encountered, the drilling fluid typically contains a quantity of weighting material that develops a bottom hole pressure exceeding the pressure of the gas that is encountered. Even though drilling fluid having a proper quantity of weighting material will prevent the occurrence of a well blowout, the hazard of well blowout is always present and thus blowout protection must be provided Blowout preventers are typically provided with internal sealing elements which are actuated hydraulically or pneumatically by pressure responsive actuator means and which drive sealing elements, typically referred to as "packings" into sealing engagement with the drill pipe or kelly which compose the drill string. Typically, these blowout preventer packings comprise large bodies of rubber or rubber-like material which have the capability, under high pressure conditions, to deform about the drill pipe or kelly and establish a pressure containing seal therewith. These devices typically function automatically in response to predetermined annulus pressure to establish a positive seal with the drill pipe or kelly.

Drilling of the well is accomplished by rotation of a drill string having a drill bit provided at the lower end thereof. The drill string is driven by a kelly, i.e., an elongate, typically six-sided drill stem that extends through a drive aperture of corresponding six-sided configuration in a rotary table. At certain times during the drilling operation, the rotating kelly is present in the drilling well head. If high pressure conditions are encountered at this time, it is necessary to provide a seal about the kelly to contain wellbore pressure and thus prevent the well from blowing out. Obviously, any rotation of the kelly relative to the packing of the blowout preventer would damage the blowout preventer or packing and render blowout protection impossible. It is desirable, therefore, to provide a rotatable packing within the blowout preventer which has the capability of being rotatably driven by the kelly while establishing and maintaining a blowout preventing seal therewith.

Prior blowout preventers such as that disclosed in U.S. Pat. No. 3,492,007 employ horizontal forces to radially compress a packing element about a rotating drill pipe or kelly U.S Pat. No. 3,587,734 of Shaffer discloses a rotatably mounted stripper seal for a conventional stationary blowout preventer. Pat. No. 4,448,255 of Shaffer, et al. discloses a rotary blowout preventer construction incorporating an inverted truncated cone for packing deformation which establishes rotary relation with a linearly movable, hydraulically energized cone actuating piston. U.S Pat. No. 3,561,723 of Cugini discloses a stripping and blowout preventer device which also incorporates a hydraulically energized piston for achieving sealing deformation of a blowout preventer packing to prevent fluid escaping form a well in the presence or absence of a well tool such as a pipe string, while rotating or stationary, or during removal of the drill string form the well bore.

For the most part, prior art blowout preventers, including rotary blowout preventers incorporate large multi-packing elements for achieving sealing with the drill string upon being appropriately deformed thereabout. Because these blowout preventers must be tested frequently to insure operability thereof, these large rubber packings or seals frequently become sufficiently worn as to require replacement. Packing wear can also be caused during shipping operations. In the typical blowout preventer device, packing replacement typically requires well drilling down time in the order of form eight to twelve hours. This is a significant detriment to the productivity of the drilling operation as well as requiring considerable expense. It is desirable, therefore, to provide a blowout preventer packing assembly having the capability of being quickly and efficiently restored to its optimum sealing capability in only a few minutes time.

Blowout preventers typically incorporate internal chevron packings to provide a positive seal separating an oil bath chamber form drilling fluid present therein. Oil in the oil bath chamber is typically circulated continuously through the internal bearings of the blowout preventer to insure its extended service life. In the event leakage develops in an internal oil seal packing, this leakage, though detrimental to the operational capability of the blowout preventer, must be tolerated until the blowout preventer can be repaired or replaced. It is desirable, therefore, to provide a rotary or non-rotary blowout preventer having an internal blowout preventer packing assembly having the capability of being restored to its positive sealing capability in the event leakage thereof is detected without necessitating disassembly of the housing thereof. It is also desirable to provide a rotary blowout preventer having internal bearings which are continuously flushed and lubricated by flow of lubricating oil therethrough.

SUMMARY OF THE INVENTION

It is a principle feature of the present invention to provide a novel rotary blowout preventer construction which is effective to establish blowout preventing sealing with the drill pipe or kelly of a drill string in response to the detection of a predetermined annulus pressure. It is also a feature of this invention to provide a novel packing assembly having a replaceable internal packing component that may be simply and efficiently replaced in only a few minutes time to restore the sealing capability of the packing assembly and to minimize the down-time of the drilling rig during blowout preventer packing repair.

It is another feature of this invention to provide a novel rotary blowout preventer construction incorporating a packing drive assembly which is rotatably mounted to the housing and which is keyed in driving relation with the primary internal packing assembly for drill string induced rotation of the primary packing within the blowout preventer housing.

It is also a feature of this invention to provide a novel blowout preventer construction incorporating a packing drive assembly including a kelly driven packing drive sleeve which permits kelly induced rotation of the kelly/drill pipe sealing packing of the blowout preventer.

It is an even further feature of this invention to provide a novel rotary blowout preventer construction incorporating an internal oil seal for insuring against leakage of drilling fluid into the oil bath of the apparatus, which seal has the capability of being hydraulically energized to restore the sealing capability thereof in the event leakage should develop.

It is also a feature of this invention to provide interrelated primary and secondary packings for blowout preventers, whether or not of rotary nature, wherein the secondary packing is replacable without necessitating disassembly of the housing.

It is also a feature of this invention to provide a novel rotary blowout preventer construction incorporating an internal pressure energized piston for accomplishing seal deformation, wherein the pressure induced force acting on the piston is controlled by partial pressure balancing.

Briefly, the various objects and features of the present invention are realized through the provision of a novel rotating blowout preventer construction incorporating a pressure containing housing structure forming a through passage through which a drill string is passed for well drilling operations. A primary packing element is positioned for rotation within the housing and is of frusto-conical configuration. The primary packing element defines a central vertically oriented passage through which extends a secondary packing element also referred to herein as a replaceable wear packing. The wear packing defines a central, vertically oriented passage through which the drill string extends during drilling operations. Both the primary packing element and the wear packing are mechanically deformable to establish sealing with the drill pipe or kelly in the event high annulus pressure is suddenly encountered.

For sealing deformation of the packings, a conical packing actuator is movably positioned within the housing and is supported for rotation by a bearing box assembly. The bearing box assembly is in turn supported by a pressure responsive piston also located within the housing and being responsive to annulus pressure for packing deforming movement of the conical packing actuator.

The support hanger, for the secondary or wear packing defines a drive receptacle within which is received a kelly drive sleeve which is rotated by the kelly. A packing drive assembly is rotatably supported by the housing structure and includes a packing drive element that is rotatably positioned within the housing and establishes driving engagement with the primary packing. The packing drive element is connected in non-rotatable relation to the support hanger and is thus rotated along with the support hanger for simultaneous rotation of the primary and secondary packings. Thus rotation of the packing drive assembly and the primary and secondary packings is accomplished by the rotating kelly which drives the kelly drive sleeve. The kelly drive sleeve is disposed in linear sliding relation with the kelly and is receivable in non-rotatable driving relation with the hanger support of the rotatable packing drive assembly.

The bearing box assembly is cooled and cleaned by continuously circulating oil of an oil bath. The oil bath is sealed by a packing gland against contamination by the drilling fluid. In the event the packing gland should leak, it may be re-pressurized hydraulically.

The housing structure is provided with open and closed hydraulic lines that permit controlled operation of the piston to its open and closed positions. The housing also includes an annulus line which is in communication with annulus pressure. The pressure of the annulus line is communicated with the open hydraulic line to establish a substantially pressure balanced condition so as to limit the upwardly directed force of the piston to a predetermined force range.

This invention also has effective application in non-rotating blowout preventers. Interrelated packing assemblies having a primary packing within which is received a secondary packing and with the secondary packing forming a passage through which the drill stem extends. The secondary packing is capable of being released from the housing of the blowout preventer and withdrawn from its interrelated assembly with the primary packing without necessitating disassembly of the blowout preventer housing.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is a sectional view of a rotating blowout preventer that is constructed in accordance with the principles of the present invention.

Figure 1:
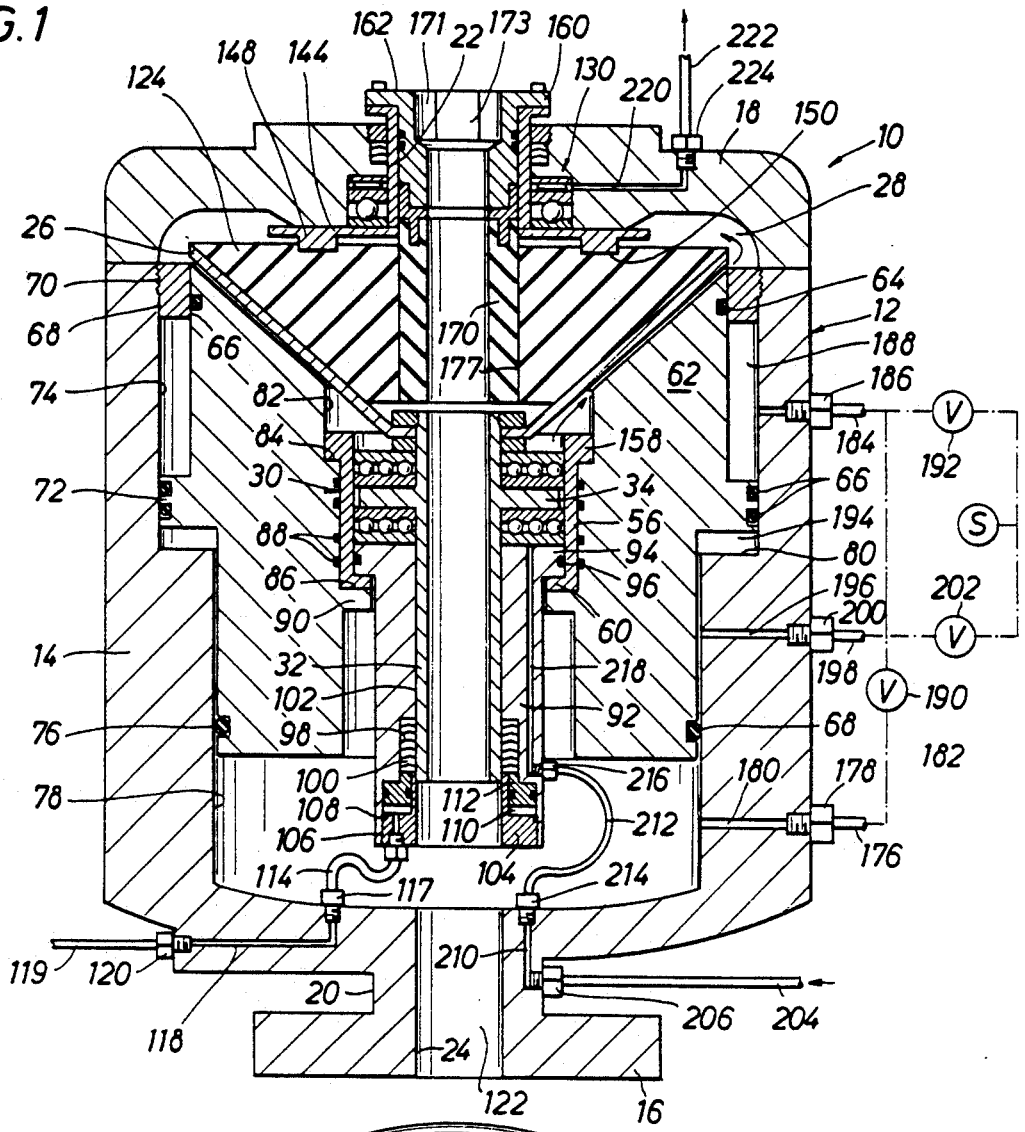
Figure 1A:
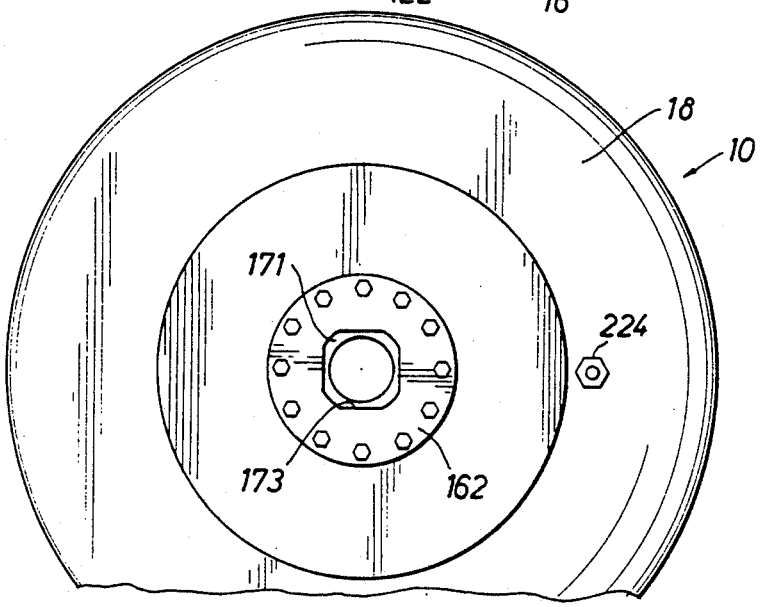

FIG. 1*a* is a plan view of the blowout preventer of FIG. 1.

Figure 1B:
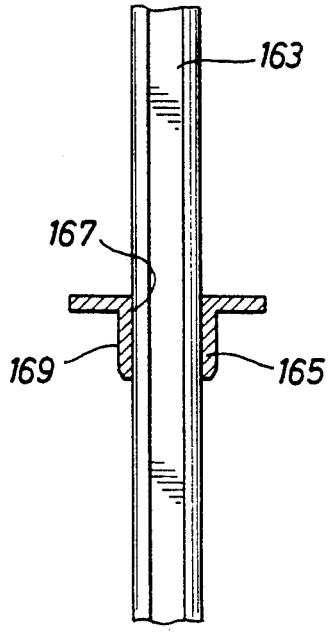

FIG. 1*b* is a sectional view of a kelly drive sleeve being shown in position on a kelly of rectangular cross-sectional configuration.

Figure 2:
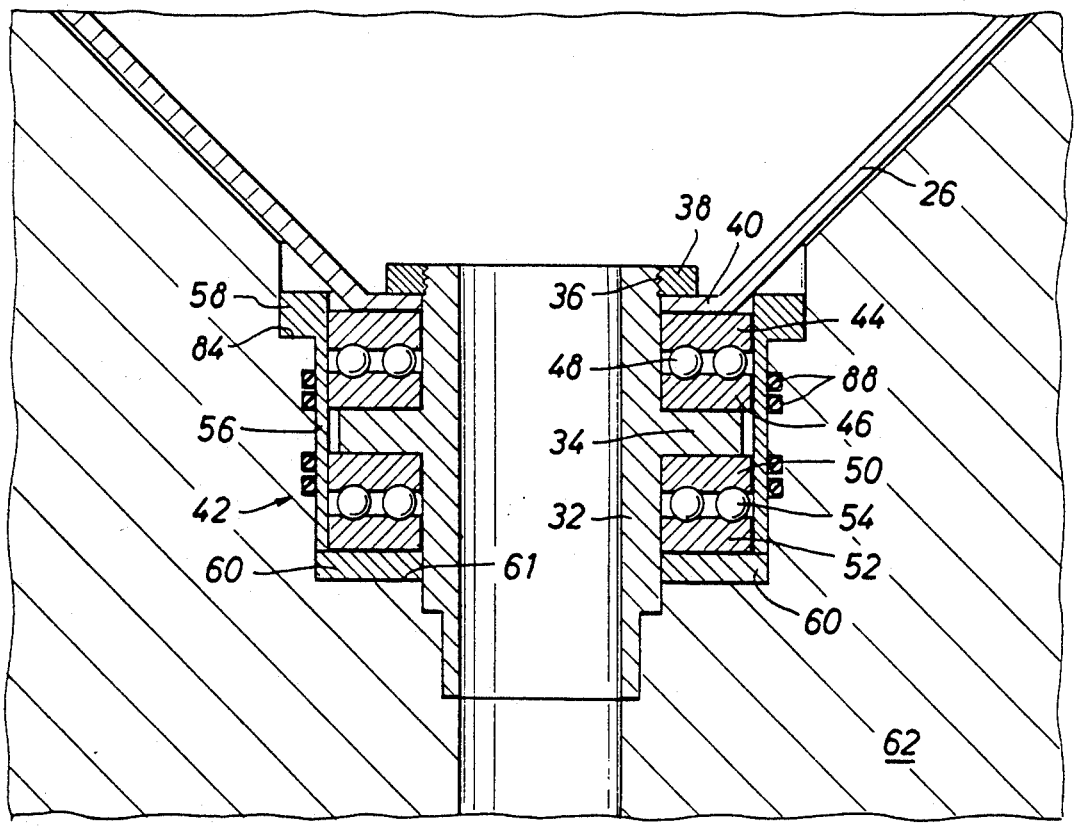

FIG. 2 is a fragmentary sectional view of the rotary blowout preventer construction of FIG. 1, illustrating the bearing box assembly and its relationship with the pressure responsive piston.

Figure 3:
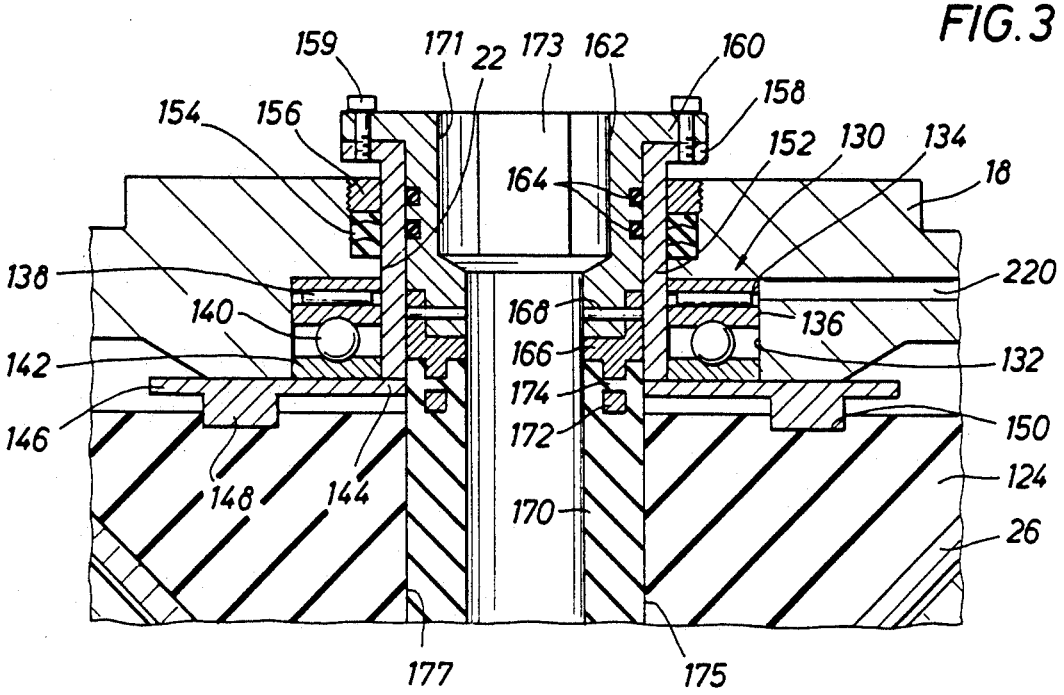

FIG. 3 is a fragmentary sectional view of the upper portion of the rotary blowout preventer construction of FIG. 1 illustrating the relationships of the primary and secondary packings and the packing drive assembly.

Figure 4:
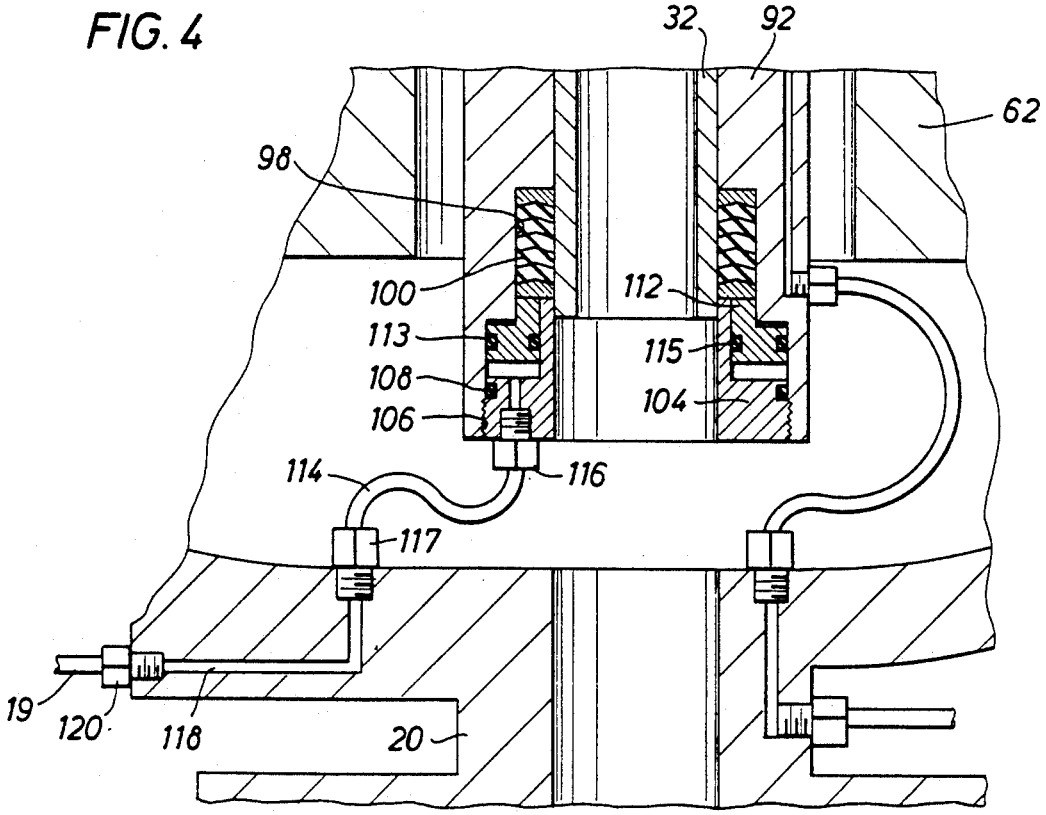

FIG. 4 is a fragmentary sectional view of the lower portion of the rotary blowout preventer of FIG. 1 showing the hydraulically energized packing and cooling oil supply systems thereof.

Figure 5:
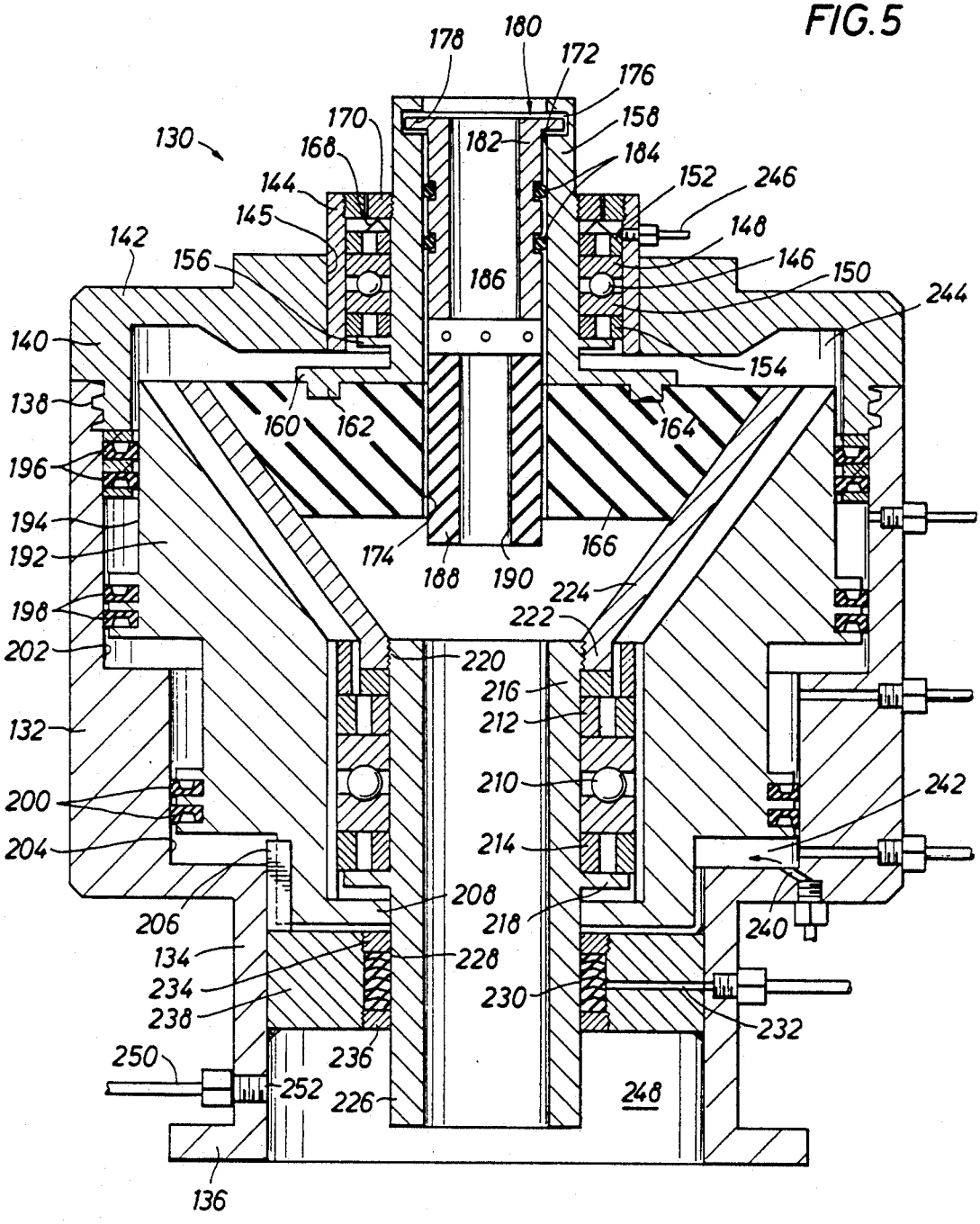

FIG. 5 is a sectional view of an alternative embodiment of the present invention.

DETAILED DESCRIPTION OF PREFERRED EMBODIMENT

Referring now to the drawings and first to FIG. 1, a rotary blowout preventer constructed in accordance with the teachings of the present invention and representing the preferred embodiment, is illustrated generally at 10. The blowout preventer construction incorporates a pressure containing housing structure illustrated generally at 12 which incorporates a housing body 14 having a connection flange 16 for bolted or other suitable connection to a drilling well head, not shown. The housing 12 is sealed by a closure or cap 18 which is secured in sealed relation to the housing body 14 by means of bolts, threads or any other suitable means of retention. The closure cap 18 and a lower housing transition member 20, together with connection flange 16, define upper and lower housing openings 22 and 24 respectively. The housing opening 24 is of a dimension capable of receiving the drill pipe and kelly of a drill string in rotatable relation therethrough.

A packing support and actuator 26 of conical configuration is movably positioned within the pressure chamber 28 and is of conical configuration, diverging upwardly. The packing support and actuator, which is preferably a rigid structure composed of a metal such as steel, is supported for rotation by means of a bearing and bearing box assembly shown generally at 30 and illustrated in detail in FIG. 2. This assembly incorporates a wash pipe and bearing support box 32 defining an intermediate radiating peripheral flange 34 which functions as a bearing support. The upper end of the bearing support tube 32 is externally threaded as shown at 36 and receives a lock ring 38 to secure an internal flange 40 of the rotary cone actuator 26 in assembly therewith.

The lock ring 38 also secures a bearing assembly shown generally at 42 in position ±or providing rotatable support for the actuator cone 26. The bearing assembly incorporates upper and lower bearings which are positioned above and below respectively in relation to the intermediate flange 34 of the bearing box. The upper bearing incorporates upper and lower bearing races 44 and 46 having ball or roller bearings 48 therebetween. The upper bearing race 44 is rotatable along with the cone element 26. The lower race 46 of the upper bearing is not rotatable. The lower bearing incorporates upper and lower bearing races 50 and 52 respectively between which are Located a plurality of spherical bearings 54.

The bearing assembly is located within a tubular bearing box 56 having upper and lower support flanges 58 and 60 respectively. The bearing box is seated within a receptacle 61 defined within the piston.

A pressure responsive piston 62 is movably positioned within the pressure chamber 28 and is sealed with respect to the housing 14 by means of upper, intermediate and lower sealing members 64, 66 and 68 respectively. Upper sealing element 64 establishes sealing relation with the inner cylindrical surface 66 of a circular insert 68 that is connected to the housing 14 by means of threads 70 or by any other suitable means of connection. Intermediate its extremities the piston defines an annular sealing flange 72 which is sealed with respect to an inner cylindrical surface 74 of the housing by means of one or more intermediate sealing elements 66. At its lower extremity the piston 62 is sealed with respect to the housing 14 by means of a circular sealing element 76 which establishes sealing with an internal cylindrical sealing surface 78 of the housing 14. The sealing surfaces 74 and 78 of the housing are radially offset from one another, forming an intermediate shoulder 80 within the housing which defines a stop shoulder for limiting downward movement of the piston.

The piston 62 defines an internal bearing receptacle 82 forming internal support shoulders 84 and 86. These support shoulders provide support for the upper and lower flanges 58 and 60 of the tubular bearing box 56. The bearing box is sealed with respect to the inner surface of the piston by means of a plurality of circular sealing elements BB. The piston element 62 further defines an internal circular thrust flange 90 which in part forms the lower bearing box support shoulder 86. The thrust support shoulder 90 supports the entire bearing box assembly and imparts thrust through the bearing assembly to the actuator cone 26.

A packing support element 92 being of generally tubular form is positioned within and supported by the piston structure 62. The packing support element 92 is provided with an upper, outwardly radiating flange 94 which is supported by the lower support flange 60 of the bearing box. The flange 94 is sealed with respect to the bearing box by means of a circular sealing element 96. At its lower end the packing support element 92 defines an internal packing gland 98 within which is located a pressure energized packing 100 such as a chevron packing or a packing of any other suitable character. This packing establishes sealing engagement with the outer cylindrical sealing surface 102 of the tubular wash pipe element 32. At its lower end the packing support element 92 is provided with an insert 104 which is secured by threads 106 and sealed by a circular sealing element 108. The insert cooperates with the lower portion of the packing support 92 to define a piston chamber 110 within which is movable located a hydraulically energized piston 112 which is sealed by inner and outer 0-rings 113 and 115 respectively. Pressurized hydraulic fluid is communicated from a suitable source, not shown, to the piston chamber 110 by means of a flexible supply hose 114 which is coupled by connector fittings 116 and 117 respectively to the insert 104 and to the housing 14. The flexible supply hose 114 receives its hydraulic fluid supply from a supply passage 118 of the housing structure 14 to which is coupled a supply line 119 by means of a connector 120. If the packing 100 should develop a leak for any reason, hydraulic pressure is applied through the supply passage defined by supply line 119, passage 118 and flexible hose 114 into the piston chamber 110, thus causing piston 112 to energize the packing to the extent that efficient sealing is again established.

It should be born in mind that although the actuator piston 62 is movable upwardly responsive to annulus pressure from the well bore or closing pressure from an auxiliary source, it does not come into forcible contact with the tapered actuator cone 26. Rather, the piston 62 is energized upwardly, thus moving the bearing box assembly upwardly to a slight extent. The upward force of the piston is directed through the bearing assembly to the actuator cone 26. Since the actuator cone is not contacted by the piston, the bearing assembly permits continuous rotation of the actuator cone even during application of upward force by the actuator piston.

For the purpose of establishing a positive seal about the drill pipe, kelly, etc. extending through the vertically oriented drill string passage 122 of the blowout preventer, a large circular mass of resilient sealing material 124, also referred to herein as a "primary packing," is located within the pressure chamber 28 and defines a lower tapered surface establishing mating, supported engagement with the upper tapered surface of the actuator cone 26. This mass of sealing material 124, which is typically referred to in the industry as "rubber" may be composed of any one of a number of elastomeric sealing materials including rubber, synthetic rubber, resilient polymer, etc. When upward force is applied to the sealing rubber or primary packing by the actuator cone 26, the sealing rubber will be deformed radially inwardly, to the extent that it conforms to the outer configuration of the drill pipe, kelly, drill collars, etc. and establishes positive sealing therewith.

As mentioned above, it is desirable that the primary packing 124 rotate along with the drill pipe or kelly even under circumstances where it is in its normal non-sealing relationship with the drill string. It is further desirable that there be provided means for quickly and efficiently restoring the sealing capability of the sealing rubber in the event of wear due to testing or use so that down time of the drilling rig will be minimized when maintenance is required. These features are accomplished through the provision of a packing drive assembly which is illustrated generally at 130 in FIG. 1 and which is shown in greater detail in FIG. 1*a* and 1*b*. The closure 18 defines an internal bearing receptacle 132 within which is located a bearing assembly comprising stacked ball and thrust bearings. For thrust support, bearing races 134 and 136 are positioned within the bearing receptacle and have a plurality of roller bearings 138 interposed in bearing relation therebetween. A plurality of ball bearings 140 are disposed between bearing races 136 and 142. A drive element 144 is positioned within the central opening 22 of the closure 18 and is provided with a bottom flange 146 which is in thrust support with the bearing race 142 and which carries a plurality of depending drive dogs 148 which are received in driving engagement with respective receptacles 150 in the upper portion of the primary packing element 124. The drive element 144 is provided with a tubular section 152 which is surrounded by the ball and thrust bearings and which is connected to the flange 158 by means of a plurality of bolts 159 and is sealed with respect to the closure 18 by means of a packing 154 secured within a packing gland by means of a packing retainer 156. The drive element 144 is provided with an upper support flange 158 which is threadedly or otherwise assembled to the tubular section 152 and which provides a support base for an outwardly radiating flange 160 of a replacement rubber support hanger 162. The support hanger 162 is sealed with respect to the tubular section 152 of the drive element 144 by means of a plurality of circular seals 164. At the lower end of the support hanger 162 is connected a replacement rubber coupler 166 by means of a plurality of connecting pins, bolts, or other suitable connectors 168. To the coupler element 166 is connected a generally cylindrical, tubular mass of resilient sealing material 170, referred to herein as a secondary packing element, which is preferably molded in assembly with the coupler 166. The secondary packing element 170 is also referred to herein as a wear rubber and is easily replacable in the event it becomes worn or deteriorated by frequent blowout preventer testing. A depending, generally cylindrical flange 172 of the coupler is preferably provided with a plurality of transverse apertures 174 thus enabling the resilient material of the wear rubber to establish an integrally connected relation with the coupler. The secondary packing 170 preferably defines a cylindrical external surface 175 and is receivable within a cylindrical bore 177 of the primary packing 124. The primary and secondary packings establish surface-to-surface sealing with one another when subjected to mechanical deformation to prevent fluid pressure leakage therebetween.

The support hanger 162 is adapted to be driven by the kelly 163 of the drill string of the well drilling equipment. A kelly drive sleeve 165 is provided which defines an internal drive opening 167 having a mating configuration with the kelly to establish a linearly slidable non-rotatable relation with the kelly. Externally the kelly drive sleeve defines flats or other drive surfaces 169 which are receivable in non-rotable relation within a drive receptacle 171 and in driving relation with internal non-circular mating drive surfaces 173 which are present within the drive receptacle. The drive surfaces 173 may be machined or otherwise formed within the support hanger 162 or, in the alternative, may be defined by one or more inserts which are attached within the receptacle by bolts or by other means of connection. As the kelly drive sleeve 165 is rotated by the kelly the drive sleeve, because of its mating, driving relation within the drive receptacle 171, it will induce driving rotation of the support hanger 162. The support hanger in turn imparts driving rotation to the packing drive element 144 by virtue of the interconnected flanges 158 and 160 and thus imparts rotation to the primary packing rubber 124 which is driven by the dogs 148 of the packing drive element. The secondary packing element, being supported in fixed assembly with the coupler element 166, which is in turn connected in non-rotatable supported relation with the support hanger 162, is rotatable along with the kelly and primary packing. The bearing supported packing deforming cone, being in supporting engagement with the primary packing, is rotated by the primary packing responsive to rotation of the kelly. Thus, when the kelly rotates for driving of the drill stem the primary and secondary packings and the packing deforming cone rotate along with the kelly. Should the blowout preventer apparatus be actuated to its closed, sealing position during rotation of the kelly, the rotating packing elements will simply be deformed by the cone 26, while being continuously rotated, until a pressure containing seal has been established by the primary and secondary packings about the kelly or drill stem. Since the kelly and the packings are rotating it will not be necessary to stop rotation of the kelly to seal against leakage of annulus pressure. Further, the secondary packing will not experience any degree of wear by virtue of sealing against a rotating kelly.

During use of the blowout preventer mechanism, it is typical to accomplish testing procedures quite often. In this case, the actuating piston is controllably cycled, or moved upwardly by the piston 62, thus causing the tapered cone 26 to deform the primary and secondary packing elements about the drill string and establish a positive seal therewith. This activity causes significant structural deformation of the sealing material of the rubber and can induce wear especially at the inner peripheral portion of the packing assembly which is defined by the secondary packing element. In order to obviate the need for replacement of the entire sealing rubber of the primary packing, which may require from six to twelve hours of work when conventional blowout preventers are employed, the present blowout preventer apparatus may be effectively serviced and efficiently restored to safe operating capability in a short period of time by replacement of the inner or secondary packing element 170, while leaving the outer, larger dimensioned primary packing element 124 in place within the blowout preventer. Removal and replacement of the central, tubular secondary packing element sealing rubber 170 is accomplished simply by unbolting the support hanger flange 160 from the flange 158 of the rotary drive element 144 and then extracting the support hanger 162 and its secondary packing element 17 upwardly. After this has been accomplished, a new support hanger and tubular sealing body or packing 170 is inserted and bolted into place. Though to save time, the support hanger 162 is typically replaced along with the coupler structure 166 and the tubular sealing rubber 170, it should be born in mind that after removal from the blowout preventer, the pin connectors 168 may be removed and a new packing rubber and coupler assembly may be reconnected to the support hanger 162. If this is done, additional maintenance will be required, but it will not begin to approximate the maintenance time that is typically required for complete replacement of the sealing rubbers of conventional blowout preventers.

For controlled operation and for automatic operation, a plurality of supply lines are coupled to the actuator housing. At its lower end, the housing is provided with an annulus pressure line 176 which is connected by threaded coupler 178 in communication with annulus supply passage 180. The pressure that is present between the well casing and drill spring, referred to as annulus pressure, is conducted via line 176 into the blowout preventer where it acts upwardly on the piston 62. This annulus pressure is also communicated as shown by the broken line 182 to an "open" pressure supply line 184 which is connected to the housing 14 by a threaded connector 186 for supply of pressure into piston actuator chamber 188. Annulus pressure in chamber 188 therefore balances a portion of the upwardly directed force that is applied to the piston by annulus pressure. Thus, the upwardly directed force on the piston can be controlled by selective positioning of the control valve 190. For controllably opening the blowout preventer by forcing the piston 62 downwardly, pressure from a suitable source, such as a pressurized hydraulic supply "S" may be communicated to the supply line 184 by selective opening of a control valve 192 While control valve 190 remains closed. For selectively closing the blowout preventer, by urging the piston 162 upwardly, such as for test cycling to insure adequate sealing capability, hydraulic pressure may be introduced into the piston chamber 194 through a housing passage 196. For this purpose, a supply line 198 extending from the source "S," is coupled to the housing 14 by means of a threaded connector 200. For this purpose, a supply control valve may be selectively opened to control application of pressure into the chamber 194. Simultaneously, the valve 192 must be opened to allow return of hydraulic fluid from the chamber 188 to the reservoir of the supply source.

For cooling the bearing assembly and to insure against contamination of the bearings by the drilling fluid an oil supply conduit 204 extending from a suitable supply such as an oil pump is connected to the lower transition section 20 of the housing 14 by means of a threaded connector 206. The passage of the connector is in communication with an oil supply passage 210 which communicates oil for cooling and flushing of the bearings to a flexible conduit 212 which is coupled by a connector 214 to the inner surface portion of the housing 14. The flexible conductor is in turn connected via a connector 216 with the packing support member 92 thus providing oil for cooling and flushing of the bearings to a passage 218 in communication with the bearings of the bearing assembly. Oil for cooling and flushing of the bearings, after flowing through the bearing assembly 30, flows upwardly between the cone 26 and the upper tapered end of the piston 62. The circulating oil then flows through the bearing assembly 130 then exits the pressure containing housing by means of an oil discharge passage 220 to an oil discharge line 222 which is coupled by threaded connector 224 to the closure portion 18 of the housing. The circulating cooling oil follows the path shown by flow arrows. The bearings and collapsible packing assembly 124 are located within an oil bath provided by the flowing oil. Line 222 extends to a suitable oil reservoir from which oil is pumped to oil supply line 204. During operation of the blowout preventer a continuous flow of oil for cooling and flushing the bearings is transmitted through the bearings which functions to remove any abrasive particulate such as drilling fluid which might find its way into the bearing assembly. The flexible conduit 212, like flexible hydraulic supply conduit 114, effectively accommodates the degree of reciprocal movement to which the piston and bearing box assembly are subjected.

Referring now to FIG. 5 an alternative embodiment of the present invention is disclosed generally at 130 which includes a housing structure 132 having a lower tubular portion 134 which is provided with a connection flange 136 enabling the blowout preventer to be bolted or otherwise connected to a conventional drilling wellhead assembly. The body structure defines coarse internal threads 138 therein which are adapted to receive the externally threaded downwardly extending connecting flange portion 140 of a closure member 142. If desired, the body and closure may be provided with any other suitable means of connection, such as bolting for example, to enable sealed closure of the blowout preventer body. The closure of the blowout preventer housing receives a bearing receptacle 144 which is disposed in fixed, sealed relation with respect to the closure and which provides for support of a bearing and packing assembly similar to that shown in FIG. 3. The bearing assembly includes a centrally oriented thrust bearing 146 having upper and lower bearing races 148 and 150 and a plurality of spherical bearing members. The bearing assembly also includes upper and lower radial bearings 152 and 154 each having inner and outer races and a plurality of cylindrical bearing members or bearing members of any other suitable configuration. The lower radial bearing 154 together with its races is seated on a bearing retainer flange 156 of a rotatable, generally tubular drive element 158 which projects through the central opening 145 of the closure 142. The drive element 158 includes a radially projecting drive flange 160 having a plurality of drive dogs 162 that are disposed in driving relation within upwardly opening drive receptacles 164 of a generally conical primary packing member 166 composed of resilient rubber-like, resilient sealing material. The primary packing may be of the same general character in configuration as shown in 124 in FIG. 1. At the upper end of the bearing assembly is provided a bearing seal 168 which is secured in position by a seal and bearing container 170.

The drive element 158 defines a vertically oriented internal bore 172 which is of approximately the same internal dimension as the internal bore 174 defined by the primary packing member 166. Additionally, the drive element 158 defines an internal "J" slot 176 which is adapted to receive the uppermost retainer flange 178 of a secondary packing assembly shown generally at 180. The secondary packing assembly includes a tubular support hanger 182 having a retainer flange 178 at its upper extremity. The tubular hanger member 182 is adapted to be sealed with respect to the internal cylindrical surface 172 of the tubular drive element 158 by means of one or more sealing members 184 which may be supported within seal retainer grooves defined by the drive element 158 or by the tubular hanger member 182. At its lower end, the hanger 182 is provided with an annular coupler 186 from which depends a generally tubular secondary packing member 188 composed of resilient rubber-like material. The packing member 188 defines a central vertically oriented bore 190 through which the drill stem extends during drilling operations.

At its upper end the tubular hanger member 182 is adapted to establish a non-rotatable relation with a kelly drive sleeve such as that shown at 165 in FIG. 1*b*. If desired, the hanger may be provided with non-circular internal drive surfaces such as shown at 173 in FIG. 3, or, in the alternative, it may be adapted to receive any other suitable drive connection that establishes non-rotatable driving relation with the kelly drive sleeve. Thus, when the kelly is rotated during drilling operations, the secondary packing assembly 180 will be rotated by the kelly drive sleeve and, through its connection with the drive element 158, will impart rotation to the drive element as well. The thrust bearing assembly will enable the drive element 158 to rotate within the central openings of the closure. The drive element, through the drive dogs 162, will impart rotation to the primary packing 166. The secondary packing assembly, being fixed by the J-slot and retainer flange connection 176–178 will be rotated along with the drive member 158. This causes the primary and secondary packings to be simultaneously rotated in response to rotation of the kelly.

Within the pressure chamber defined by the housing structure, together with its closure, a piston member 192 is mounted for pressure induced linear movement. At its upper end the piston defines a cylindrical surface 194 which is in sealed engagement with respect to the body structure by means of a pair of pressure energized seals 196 which are carried within annular seal grooves that are defined within the blowout preventer body. The piston carries intermediate seals 198 and lower seals 200 which are retained in seal grooves defined by the piston and which establish sealing engagement respectively with internal annular sealing surfaces 202 and 204. The piston is restrained against rotation with respect to the body structure of the housing by means of interrelated keyway and spline structures 206 which are defined respectively by the housing and the piston. The piston 192 may be restrained against rotation relative to the body by any other suitable mechanism as well. The piston 192 also defines an internally projecting drive flange 208 which establishes driving relation with a bearing assembly including a thrust bearing as shown at 210 and upper and lower radial bearings as shown at 212 and 214. The bearing assembly is provided about a wash pipe 216 having an intermediate bearing support flange 218. At its upper end the wash pipe defines external threads 220 which receive an internally threaded lower connecting portion 222 of a packing support and actuator member 224. The threaded lower end 222 of the actuator also serves as a bearing retainer which serves to maintain bearings 210, 212 and 214 properly secured between the flange 218 and the bearing retainer 222. The actuator is of generally conical construction defining an internal conical surface that reacts with the conical external surface of the primary packing 166. The actuator is rotatable along with the primary packing and, through its connecting portion 222, imparts simultaneous rotation to the wash pipe 216. As the actuator 224 is driven upwardly responsive to upward movement of the piston 192, the primary packing is squeezed radially inwardly against the secondary packing 188 thus establishing a seal with the secondary packing and squeezing the secondary packing into sealing engagement with the drill string extending therethrough.

At its lower end the wash pipe defines a cylindrical external surface 226 which is disposed in sealing engagement with a packing assembly 228. The packing assembly 228 is of the chevron type and defines a lubricant space 230 intermediate thereof into which lubricant is injected through a passage 232 for the purpose of enhancing the sealing capability thereof. The packing assembly incorporates upper and lower retainers 234 and 236 which are typically formed of brass or bronze and which retain the packing assembly within a packing gland defined within an internally projecting flange 238 of the blowout preventer body. The retainers 234 and 236 are threadedly received by the packing support flange 238.

The blowout preventer body also defines a lubricating and flushing passage 240 through which lubricating oil is injected into the internal chamber 242. From this chamber, the lubricating oil flows upwardly through the bearing assembly incorporating thrust bearing 210 and radial bearings 212 and 214 and thence the lubricating oil flows upwardly through the annular space between the actuator member 224 and the internal surface of the piston 192 until it reaches the upper chamber space 244. Thereafter, the flow of lubricating oil traverses the upper bearing assembly including thrust bearing 146 and radial bearings 152 and 154. The oil flow exits the upper bearing assembly through oil return passage 246. Any debris, such as drilling fluid particulate that might enter the chamber 242 past the packing assembly 228 will be flushed from the blowout preventer by the continuously circulating oil.

To enable bleeding of the chamber portion 248 below the chevron packing assembly, the tubular portion 134 of the housing structure is provided with a relief valve 250 which is communicated via passage 252 with the chamber portion 248. In the event it becomes desirable to relieve pressure within the chamber 248, the relief valve 250 is opened to vent the excessive pressure to the atmosphere, or to any other suitable receptacle.

It should be born in mind that the upper and lower bearing assemblies are subject to change without altering the spirit and scope of the present invention. Any type of bearings may be employed which permit rotation of the primary and secondary packings within the internal chamber of the blowout preventer housing. Upon rotation of the kelly, the kelly imparts driving force for rotation of the drive element 158 and the hanger 182 together with the primary and secondary packings. The primary packing, by virtue of its contact with the tapered actuator 224 imparts rotation to the actuator and to the wash pipe 216. The lower bearing assembly enables the wash pipe to rotate relative to the piston 192 even when under load induced by pressure induced actuation of the piston. As the wash pipe rotates, it is maintained in sealed relation with the housing structure of the blowout preventer by the Chevron packing assembly shown at 228.

When it becomes desirable t o replace the secondary packing 188, such as due to wear induced by stripping operations or by virtue of having been deformed a number of times for test sealing with respect to the kelly or drill pipe of the tubing string, the flange 178 is simply unbolted or otherwise released and is then counter-rotated. This counter rotation causes the "J" slot connection 176 with the flange 178 to release the flange. Thereafter, the secondary packing assembly 180 is simply raised and withdrawn from within the blowout preventer housing. A new secondary packing assembly 180 is then extended over the drill pipe and positioned such as shown in FIG. 5. It is rotated relative to the tubular portion of the drive element 158 sufficiently to cause the "J" slot connection to lock the new secondary packing assembly in place. Bolts or other suitable retainers may then be assembled to retain the "J" slot connection against inadvertent disassembly.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing form its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A rotary blowout preventer through which the rotatable drill string including a kelly and drill pipe extend and which is capable of establishing a seal with said rotatable drill string to contain annulus pressure and prevent a blowout, said rotary blowout preventer comprising:

(a) a pressure containing housing adapted for mounting to a drilling well head and adapted to receive a drill string therethrough;

(b) a pressure responsive element being positioned for pressure induced linear movement within said pressure containing housing;

(c) a primary packing element being positioned for rotation within said pressure containing housing and defining a central opening through which said drill string is extended for well drilling;

(d) a secondary packing element being received within said central opening of said primary packing element and defining a drill string passage through which said drill string is movable;

(e) a packing deforming element being rotatably supported by said pressure responsive element and having non-rotatable engagement with said primary packing element, said packing deforming element being linearly movable by said pressure responsive element, deforming said primary and secondary packing about said drill string thus establishing a seal therewith for containing annulus pressure; and (f) packing drive means being rotatably supported by said pressure containing housing and being rotatably driven by said kelly and imparting driving rotation to at least one of said primary and secondary packing elements.

2. The rotary blowout preventer of claim 1, wherein:

(a) said secondary packing element defines a first drive connection; and (b) a kelly drive sleeve defining a second drive connection and being adapted for rotary driving relation with said first drive connection, said kelly drive sleeve being adapted to establish a non-rotatable, linearly movable driven relation with said kelly.

3. The rotary blowout preventer of claim 2, wherein: said secondary packing element is connected with said packing drive means for driving rotation therewith.

4. The rotary blowout preventer of claim 2, wherein:

(a) said first drive connection being non-circular drive receptacle being provided within said secondary packing element; and (b) said second drive connection being an external non-circular drive structure provided on said kelly drive sleeve and being receivable in mating driving relation within said non-circular drive receptacle.

5. The rotary blowout preventer of claim 1, wherein:

(a) said pressure containing housing defines an upwardly directed central opening;

(b) a support hanger being positioned within said upwardly directed central opening; and (c) said secondary packing element being supported by said support hanger.

6. The rotary blowout preventer of claim 5, wherein:

(a) a connecting coupler is releasably supported by said support hanger; and (b) said secondary packing element being supported and positioned by said connecting coupler.

7. The rotary blowout preventer of claim 5, wherein:

(a) said support hanger defines a drive receptacle; and (b) a kelly drive sleeve is receivable in driving relation within said drive receptacle and is adapted to receive said drill string in driving relation therein for imparting rotation to said kelly drive sleeve, said support hanger and said secondary packing element.

8. The rotary blowout preventer of claim 1, wherein:

(a) said primary packing element defines a vertically oriented centrally located passage therethrough; and (b) said secondary packing element being of generally cylindrical, tubular configuration, forming an outer surface establishing intimate sealing engagement with said centrally located passage of said primary packing element, said secondary packing element having a vertically oriented, centrally located pipe passage therein for receiving said drill string therethrough.

9. The rotary blowout preventer of claim 1, wherein said packing drive means comprises:

(a) upwardly facing drive receptacles being defined by said primary packing element at the upper portion thereof; and (b) a bearing supported rotatable drive element being disposed for rotary movement within said central opening of said housing and having a plurality of downwardly projecting driving dogs disposed in interengaging driving relation within said upwardly facing drive receptacles.

10. The rotary blowout preventer of claim 9, wherein:

(a) said secondary packing element is connected to said bearing supported rotatable drive element; and (b) a kelly driven element is receivable in driving engagement with said secondary packing element and is adapted for rotary driving engagement with said kelly.

11. The rotary blowout preventer of claim 9, including:

a packing element being supported by said housing and establishing sealing engagement with said rotatable drive element.

12. The rotary blowout preventer of claim 9, wherein:

a bearing assembly is supported by said housing and provides force resisting support for said rotary drive element, said packing assembly including bearing races having roller bearings therebetween and bearing races having ball bearings therebetween.

13. The rotary blowout preventer of claim 1, wherein:

(a) said pressure responsive element is a piston element being sealed with respect to said housing, said piston element defining a central receptacle therein and further defining an upwardly directed thrust shoulder;

(b) a bearing box assembly being disposed within said central receptacle of said piston element and being of generally tubular form having the lower end thereof supported by said upwardly directed thrust shoulder; and (c) a bearing assembly being disposed within said bearing box and providing rotary support for said packing deforming element.

14. The rotary blowout preventer of clam 13, wherein said bearing assembly comprises:

(a) a tubular wash pipe element having an outwardly directed flange forming upper and lower circular thrust shoulders;

(b) a first bearing being supported by said piston and having thrust supporting engagement with said lower thrust supporting surface of said tubular wash pipe; and (c) a second bearing being located within said bearing box and being supported by said upper thrust surface of said wash pipe.

15. The rotary blowout preventer of claim 14, wherein:

each of said first and second bearings comprises upper and lower bearing races having a plurality of bearing elements interposed therebetween.

16. The rotary blowout preventer of claim 13, including:

a packing support element being supported by said piston and having a packing element supported thereby and disposed in sealing engagement with said wash pipe element.

17. The rotary blowout preventer of claim 14, wherein:

(a) said packing support element defines an actuator chamber;

(b) a hydraulically energized piston being disposed within said actuator chamber and having force transmitting engagement with said packing gland;

(c) a hydraulic fluid supply being disposed in communication with said actuator chamber and providing pressurized hydraulic fluid for sealing energization of said packing gland by hydraulically transmitted force of said hydraulic piston.

18. The rotary blowout preventer of claim 14, including:

an oil supply circuit being provided within said housing and having an oil supply line extending from said housing, said oil supply circuit being in communication with said bearing assembly for transmitting a flow of oil through said bearing assembly for cooling and cleaning thereof.

19. The rotary blowout preventer of claim 18, including:

(a) a packing support element being supported by said piston, said packing support element defining an oil supply passage therein; and (b) a flexible conduit being connected to said packing support element in communication with said oil supply passage and being connected to said housing in communication with said oil supply circuit thereof, said flexible conduit maintaining oil supply communication at all positions of said piston and packing support within said housing.

20. The rotary blowout preventer of claim 1, wherein:

(a) said piston cooperates with said housing to define a first chamber for receiving annulus pressure, a second chamber for receiving opening pressure and a third chamber for receiving closing pressure;

(b) first, second and third supply conduits for respectively communicating annulus pressure to said first chamber, closing pressure to said second chamber, and opening pressure to said third chamber; and (c) valve means for selectively controlling the inlet and venting of pressure from said second and third chambers for achieving controlled opening and closing movement of said piston such as for testing of rotary blowout preventer.

21. A rotary blowout preventer through which the rotatable drill string including a kelly and drill pipe extend and which is capable of establishing a seal with said rotatable drill string to contain annulus pressure and prevent a blowout, said rotary blowout preventer comprising:

(a) a pressure containing housing adapted for mounting to a drilling well head and defining upper and lower openings for receiving said rotatable drill string during well drilling;

(b) a pressure responsive piston being disposed for pressure induced linear movement within said housing;

(c) a primary packing element being located within said pressure containing housing and defining a central opening through which said drill string is extended for well drilling;

(d) a secondary packing element being received within said central opening of said primary packing element and defining a vertically oriented drill string passage;

(e) a packing deforming element being rotatably supported by said pressure responsive piston and having non-rotatable supporting engagement with said primary packing piston, said packing deforming element being linearly movable in one direction by said pressure responsive element, for inducing sealing deformation of said primary and secondary packing elements about said drill string to contain annulus pressure; and (f) a kelly drive sleeve adapted to receive said kelly in linearly movable, non rotatable relation therethrough, said kelly drive sleeve defining a first drive connection; and (g) a packing drive element being supported for rotation within said pressure containing housing and establishing driving connection with said primary packing element for rotation of said primary packing element.

22. The rotary blowout preventer of claim 21, including:

a support hanger being disposed in non-rotatable relation with said packing drive element and defining a second drive connection having driving assembly with said first drive connection for inducing rotary movement of said support hanger and said packing drive element upon rotation of said kelly, said secondary packing element being supported by and rotatable with said support hanger.

23. The rotary blowout preventer of claim 21, wherein said packing deforming element comprises:

(a) an upwardly diverging cone being disposed in intimate engagement with said primary packing element and adapted upon linear movement thereof within said pressure containing housing to induce said deformation of said primary packing element and said secondary packing element about said drill string; and (b) bearing means providing rotary support for said upwardly diverging cone said bearing means being in thrust transmitting assembly with said pressure responsive element.

24. The rotary blowout preventer of claim 22, wherein said pressure responsive piston comprises:

a piston element having sealed engagement with said pressure containing housing and partitioning said pressure containing housing into an annulus pressure chamber a piston return chamber and a test chamber, introduction of annulus pressure into said annulus pressure chamber or said test chamber moving said piston in a direction for said deformation of said primary and secondary parking elements, introduction of pressure into said piston return chamber moving said piston in a direction away from said primary and secondary packing elements.

25. A blowout preventer construction comprising:

(a) a pressure containing housing defining upper and lower openings through which a drill stem is adapted to extend;

(b) a primary packing element being located within said housing and defining a centrally oriented opening;

(c) a secondary packing element being located within said centrally oriented opening and defining a centrally oriented drill stem passage, said secondary packing element being accessible and removable from said central opening of said primary packing element without opening of said pressure containing housing to enable simple and quick replacement thereof; and (d) a pressure responsive piston being located within said pressure containing housing and defining an annulus pressure chamber within said pressure responsive housing, said pressure responsive piston being linearly movable within said pressure containing housing upon communication of predetermined annulus pressure into said annulus pressure chamber and deforming said primary and secondary packing elements about said drill stem to establish an annulus pressure containing seal with said drill stem to prevent a well blowout.

* * * * *